US010518539B2

(12) United States Patent
Muto et al.

(10) Patent No.: US 10,518,539 B2
(45) Date of Patent: Dec. 31, 2019

(54) LIQUID EJECTING APPARATUS AND CLEANING METHOD

(71) Applicant: SEIKO EPSON CORPORATION, Tokyo (JP)

(72) Inventors: Atsushi Muto, Shiojiri (JP); Masahiko Sato, Matsumoto (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/905,468

(22) Filed: Feb. 26, 2018

(65) Prior Publication Data

US 2018/0244047 A1 Aug. 30, 2018

(30) Foreign Application Priority Data

Feb. 28, 2017 (JP) ..... 2017-037456

(51) Int. Cl.

| | |
|---|---|
| ***B41J 2/14*** | (2006.01) |
| ***B41J 2/165*** | (2006.01) |
| ***B41J 2/025*** | (2006.01) |
| ***B41J 2/045*** | (2006.01) |
| ***B41J 2/155*** | (2006.01) |

(52) U.S. Cl.

CPC ..... *B41J 2/16523* (2013.01); *B41J 2/025* (2013.01); *B41J 2/04541* (2013.01); *B41J 2/14032* (2013.01); *B41J 2/14274* (2013.01); *B41J 2/155* (2013.01); *B41J 2002/14306* (2013.01); *B41J 2002/14459* (2013.01)

(58) Field of Classification Search

CPC ..... B41J 2/16523; B41J 2/16508; B41J 2/14233; B41J 2/16532; B41J 2/155; B41J 2/04541; B41J 2/14032; B41J 2/12474; B41J 2/025; B41J 2002/14491; B41J 2002/14419; B41J 2002/14306; B41J 2002/14459

See application file for complete search history.

(56) References Cited

U.S. PATENT DOCUMENTS

2015/0035910 A1* 2/2015 Kinoshita ..... B41J 2/14233 347/68

FOREIGN PATENT DOCUMENTS

| | | | |
|---|---|---|---|
| JP | 2002-144576 | A | 5/2002 |
| JP | 2003-127403 | A | 5/2003 |
| JP | 2009-66781 | A | 4/2009 |
| JP | 2015-212047 | A | 11/2015 |

* cited by examiner

*Primary Examiner* — Sharon A. Polk
(74) *Attorney, Agent, or Firm* — Workman Nydegger

(57) ABSTRACT

A liquid ejecting apparatus includes a flow path member including a common liquid chamber communicating with each of a plurality of nozzles formed in a nozzle surface, via a corresponding pressure generating chamber, a supply port provided in an inner wall of the common liquid chamber to supply a liquid to the common liquid chamber, a discharge port provided in a ceiling of the common liquid chamber to discharge an air bubble from the common liquid chamber, and a wall continuously extending from the inner wall, and including a surface opposing the discharge port.

11 Claims, 12 Drawing Sheets

LIQUID EJECTING APPARATUS AND CLEANING METHOD

CROSS-REFERENCE TO RELATED APPLICATIONS

This application claims priority to Japanese Patent Application No. 2017-037456 filed on Feb. 28, 2017. The entire disclosures of Japanese Patent Application No. 2017-037456 are hereby incorporated herein by reference.

BACKGROUND

1. Technical Field

The present invention relates to a liquid ejecting apparatus including a liquid ejecting head that ejects a liquid from a nozzle and a flow path member, and a cleaning method of the liquid ejecting apparatus, more particularly to an ink jet recording apparatus that employs ink as the liquid, and a cleaning method thereof.

2. Related Art

An ink jet recording head, a typical example of the liquid ejecting head that ejects liquid droplets, generally includes nozzles, a plurality of pressure generating chambers communicating with the respective nozzles, and a manifold serving as a common liquid chamber communicating with the pressure generating chambers, and is configured to generate pressure fluctuation to the ink in the pressure generating chamber with a pressure generating device such as a piezoelectric actuator, to thereby eject ink droplet through the nozzles.

In the ink jet recording head configured as above, when air bubbles contained in the ink intrude into the pressure generating chamber, a malfunction such as inadequate ejection is incurred. Accordingly, for example JP-A-2015-212047 and JP-A-2009-066781 propose a method of collecting the air bubbles for example in the manifold, and discharging the air bubbles through a discharge port.

However, in the case where the discharge port is provided in the ceiling, the air bubbles tend to concentrate in a location right under the discharge port, and components of the ink deposited in such a location precipitate, so as to change the characteristics of the ink. When such ink of different characteristics is introduced into the pressure generating chamber, problems such as an uneven printing result and degradation in ejection stability may be incurred. In particular, when the common liquid chamber has a large capacity, the flow velocity of the ink located right under the discharge port is reduced, which facilitates a change in characteristics of the ink, and also facilitates the ink of different characteristics to be introduced into the pressure generating chamber.

On the other hand, reducing the capacity of the common liquid chamber, so as to prevent the ink from stagnating, leads to declined ink supply capacity to the pressure generating chamber, and degradation in absorption capacity of the pressure fluctuation that takes place when the ink droplet is ejected, thus making it difficult to stably eject the ink droplets.

The foregoing drawbacks are also incidental to liquid ejecting apparatuses that eject a liquid other than the ink, in addition to the ink jet recording apparatus.

SUMMARY

An advantage of some aspects of the invention is to provide a liquid ejecting apparatus configured to prevent a liquid, with the characteristics changed because of stagnating, from being introduced into the pressure generating chamber, and a cleaning method of the liquid ejecting apparatus.

In an aspect, the invention provides a liquid ejecting apparatus including a flow path member including a common liquid chamber communicating with each of a plurality of nozzles formed in a nozzle surface, via a corresponding pressure generating chamber, a supply port provided in an inner wall of the common liquid chamber to supply a liquid to the common liquid chamber, a discharge port provided in a ceiling of the common liquid chamber to discharge an air bubble from the common liquid chamber, and a wall continuously extending from the inner wall of the common liquid chamber, and including a surface extending along the ceiling and opposing the discharge port.

With the mentioned configuration, even when the liquid stagnates right under the discharge port, and the components precipitate thereby provoking a change in characteristics of the liquid, the wall prevents the liquid of different characteristics from being introduced into the pressure generating chamber.

Preferably, the ceiling of the common liquid chamber may include a sloped surface formed so as to be farther from the nozzle surface, toward the discharge port. Such a configuration allows the air bubble to migrate along the ceiling toward the discharge port, because of buoyancy effect, thereby improving discharge efficiency of the air bubble through the discharge port, thus preventing the air bubble from intruding into the pressure generating chamber.

Preferably, the wall may include a floor surface opposing the ceiling, and formed so as to be closer to the nozzle surface, toward the discharge port. The mentioned configuration allows the liquid of different characteristics to be stored between the ceiling and the floor surface, thereby further assuring the prevention of the liquid of different characteristics from being introduced into the pressure generating chamber.

Preferably, the supply port may be provided in the ceiling of the common liquid chamber, the wall may be configured so as to generate, in the common liquid chamber, a first flow from the supply port to a plurality of the pressure generating chambers, and a second flow from the supply port to the discharge port, and a portion of the wall that generates the first flow may include a sloped surface formed so as to be closer to the nozzle surface, in a direction away from the supply port. In this case, the first flow proceeds along the sloped surface, and therefore the region where the liquid may stagnate can be reduced, and production of the liquid of different characteristics can be suppressed.

Preferably, the wall may be configured so as to generate, in the common liquid chamber, a first flow from the supply port to a plurality of the pressure generating chambers, and a second flow from the supply port to the discharge port, and the first flow and the second flow may be branched at a position upper than a center of the common liquid chamber, in a direction in which the ceiling and a portion of the common liquid chamber communicating with the pressure generating chamber oppose each other. In this case, the liquid of different characteristics between the wall and the ceiling can be located distant from the pressure generating chamber, and portions of the liquid having different characteristics can be sufficiently mixed with each other, even though the liquid of different characteristics migrates toward the pressure generating chamber. Therefore, the liquid of different characteristics can be more effectively prevented from being introduced into the pressure generating chamber.

Preferably, the discharge port may be located on an outer side of the pressure generating chamber, in a direction in which the pressure generating chambers are aligned. In this case, the liquid of different characteristics stagnating right under the discharge port can be located distant from the pressure generating chamber, and the portions of the liquid having different characteristics can be sufficiently mixed with each other, even though the liquid of different characteristics migrates toward the pressure generating chamber. Therefore, the liquid of different characteristics can be more effectively prevented from being introduced into the pressure generating chamber.

Preferably, the discharge port may communicate with a degassing chamber including a gas-liquid separation wall. In this case, the air bubble in the liquid can be discharged from the discharge port, through the degassing chamber.

Preferably, the discharge port may be configured to discharge the air bubble inside the common liquid chamber. In this case, the air bubble in the liquid can be discharged from the discharge port, through the degassing chamber.

Preferably, the discharge port may be configured to return the liquid, supplied through the supply port from a tank for storing the liquid, to the tank. In this case, the air bubble in the liquid can be discharged from the discharge port, through the degassing chamber.

In another aspect, the invention provides a cleaning method of a liquid ejecting apparatus including a flow path member including a common liquid chamber communicating with each of a plurality of nozzles provided in a nozzle surface, via a corresponding pressure generating chamber, a supply port provided in an inner wall of the common liquid chamber to supply a liquid to the common liquid chamber, a discharge port provided in a ceiling of the common liquid chamber to discharge an air bubble from the common liquid chamber, and a wall continuously extending from the inner wall of the common liquid chamber, and including a surface extending along the ceiling. The method includes discharging the liquid through the nozzle when removing the air bubble with a pump communicating with the discharge port.

The mentioned arrangement allows reduction of the region where the liquid may stagnate around the wall, by discharging the liquid from the discharge port and from the nozzle at the same time. Therefore, the production of the liquid of different characteristics due to the stagnation of the liquid flow can be suppressed, and consequently the liquid of different characteristics can be prevented from being introduced into the pressure generating chamber, during the printing operation after the cleaning.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
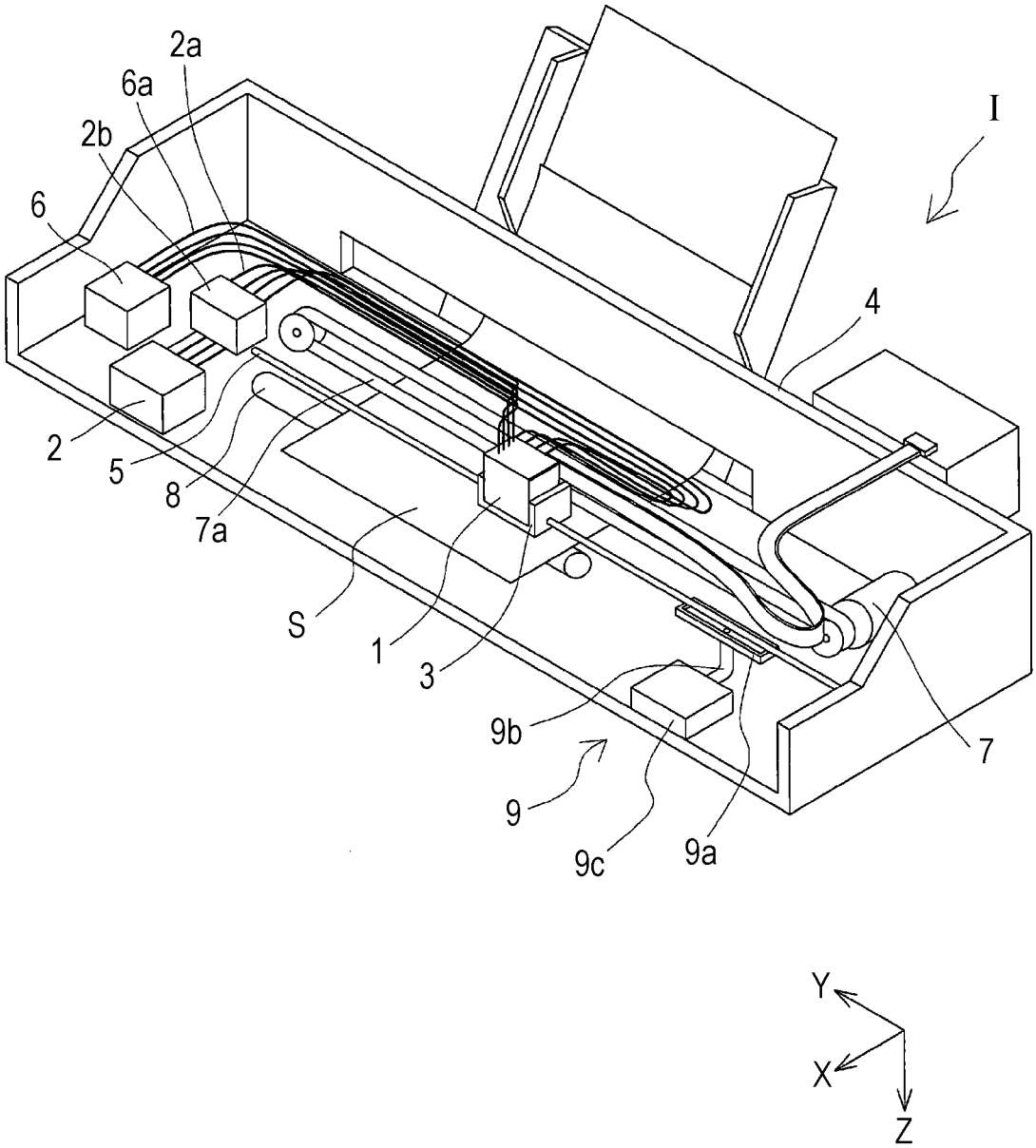
FIG. 1 is a schematic perspective view showing a general configuration of a recording apparatus according to a first embodiment of the invention.

Hereafter, embodiments of the invention will be described with reference to the drawings. The following description merely represent an example of the invention, which may be modified as desired within the scope of the invention. The same elements are given the same numeral, and the description thereof will be omitted where appropriate. In the drawings, codes X, Y, and Z denote three spatial axes orthogonal to one another. In the following description, the directions along these axes will be referred to as a first direction X, a second direction Y, and a third direction Z. The third direction Z represents a vertical direction, and an upper side in the vertical direction will be referred to as Z1-side, and a lower side in the vertical direction will be referred to as Z2-side.

First Embodiment

FIG. 1 is a schematic perspective view showing a general configuration of an ink jet recording apparatus, exemplifying a liquid ejecting apparatus according to a first embodiment of the invention.

As shown in FIG. 1, an ink jet recording head 1 (hereinafter, simply recording head 1 as the case may be), exemplifying the liquid ejecting head, is mounted on a carriage 3, in an ink jet recording apparatus I exemplifying the liquid ejecting apparatus. The carriage 3 having the recording head 1 mounted thereon is attached to a carriage shaft 5 so as to move in an axial direction, the carriage shaft 5 being fixed in a main body 4. In this embodiment, the moving direction of the carriage 3 corresponds to the second direction Y.

The main body 4 includes a storage device 2 constituted of an ink tank in which ink, an example of the liquid, is stored, and the storage device 2 is connected to the recording head 1 via a supply pipe 2*a* such as a tube. Halfway of the supply pipe 2*a*, a pressure-feed device 2*b* such as a pressure pump is provided, to press-feed the ink in the storage device 2 toward the recording head 1. The pressure-feed device 2*b* is not limited to the pressure pump but may be, for example, a pressing device that presses the outer periphery of the storage device 2 from outside. Alternatively, the pressure-feed device 2*b* may utilize a difference in hydraulic head pressure generated upon adjusting a relative position between the recording head 1 and the storage device 2 in the vertical direction. Thus, the pressure-feed device 2*b* may be provided, for example, in a non-illustrated holder that regains the storage device 2, without limitation to the position halfway of the supply pipe 2*a*.

In this embodiment, the main body 4 includes a depressurizing device 6 connected to a degassing chamber in the recording head 1, the details of which will be subsequently described, via a discharge pipe 6*a* such as a tube. The depressurizing device 6 includes a depressurization pump such as a vacuum pump, and serves to reduce the pressure in the degassing chamber in the recording head 1, by sucking the air in the degassing chamber. Reducing thus the pressure in the degassing chamber with the depressurizing device 6 allows air bubbles contained in the ink in the recording head 1, the details of which will be subsequently described, to be discharged through the degassing chamber. When the degassing chamber is depressurized by the depressurizing device 6, the depressurized state in the degassing chamber can be maintained, for example with a non-illustrated on-off valve for opening and closing the outlet of the discharge pipe 6*a* and the degassing chamber, without the need to constantly activate the depressurizing device 6.

When driving force of a drive motor 7 is transmitted to the carriage 3 via a plurality of non-illustrated gears and a timing belt 7*a*, the carriage 3 having the recording head 1 mounted thereon is moved along the carriage shaft 5. The main body 4 includes a transport roller 8 serving as a transport device, which transports a recording sheet S, which is a recording medium such as a paper sheet. The transport device for transporting the recording sheet S is not limited to the transport roller 8, but may be a belt or a drum. In this embodiment, the transport direction of the recording sheet S corresponds to the first direction X.

In addition, a suction device 9 that sucks the ink from the nozzle of the recording head 1 is provided at an end portion of the carriage 3 in the second direction Y, in which the carriage 3 moves.

The suction device 9 includes a cap 9*a* covering the nozzle of the recording head 1 and formed of an elastic material such as rubber or elastomer, and a suction device 9*c*, for example a vacuum pump, connected to the cap 9*a* via a suction pipe 9*b* such as a tube.

The suction device 9 configured as above activates the suction device 9*c* with the cap 9*a* brought into contact with the nozzle surface of the recording head 1, to generate a negative pressure inside the cap 9*a*, and performs a cleaning operation by sucking the ink inside the recording head 1 through the nozzle, together with air bubbles. During an off state of the apparatus, the cap 9*a* may close the nozzle to prevent drying of the nozzle.

Since the cap 9*a* is brought into contact with the nozzle surface of the recording head 1 to cover the nozzle at a desired timing, the cap 9*a* according to this embodiment is movable in the third direction Z. The cap 9*a* can be driven to move, for example, by a driving device such as a non-illustrated drive motor or electromagnet.

Figure 2:
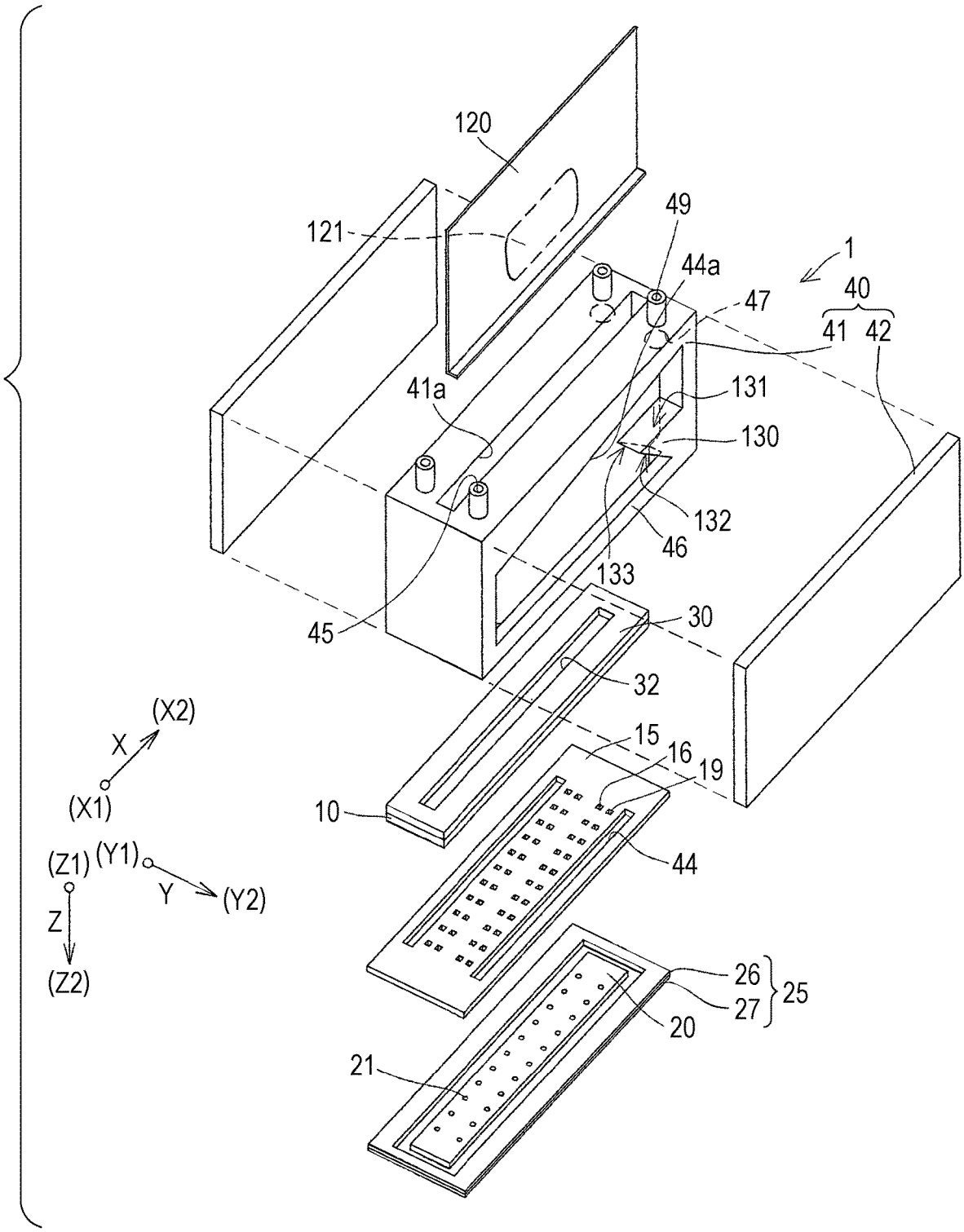
FIG. 2 is an exploded perspective view of a recording head according to the first embodiment of the invention.
Figure 3:
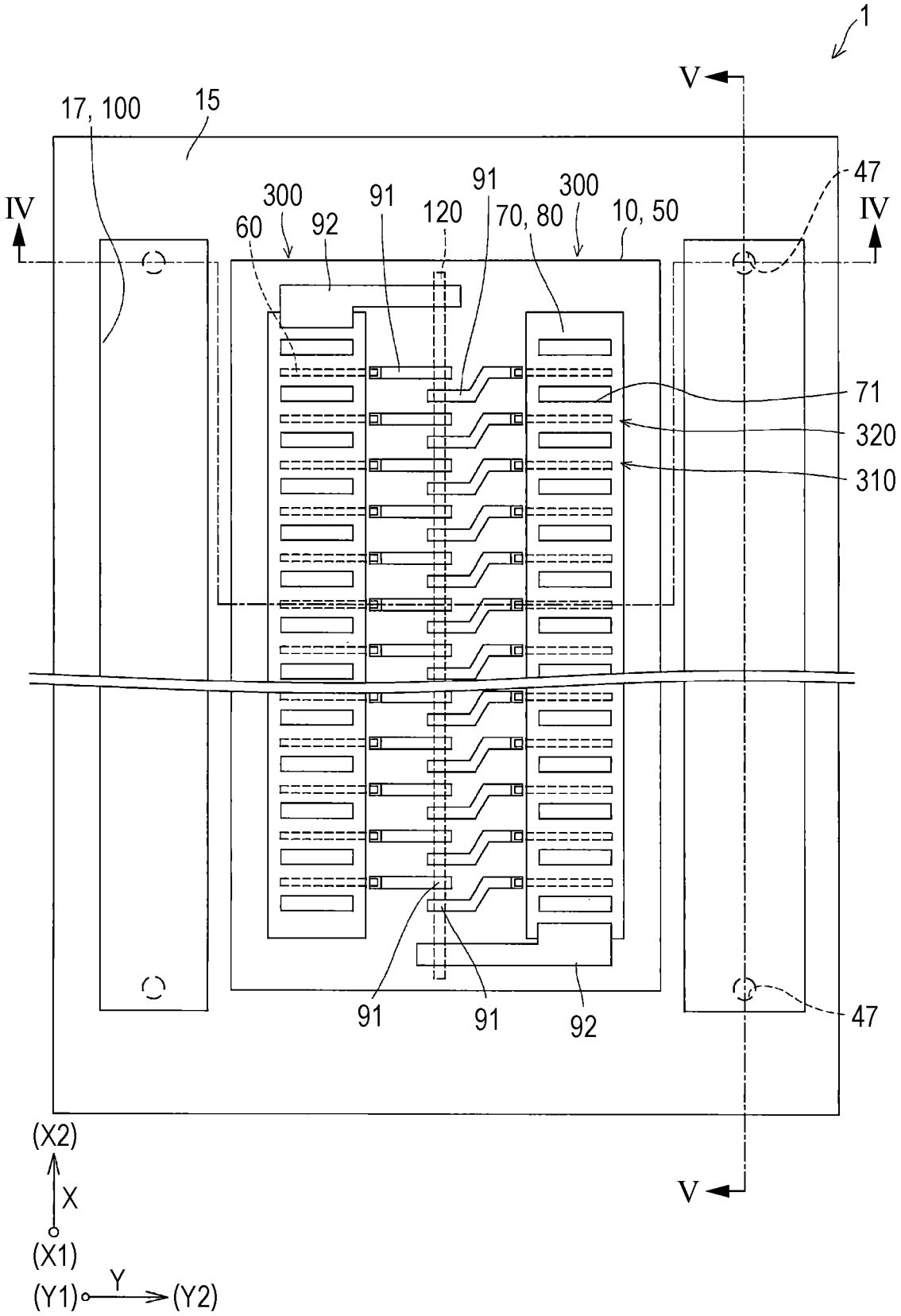
FIG. 3 is a plan view of a flow path substrate and a communication plate according to the first embodiment of the invention.
Figure 4:
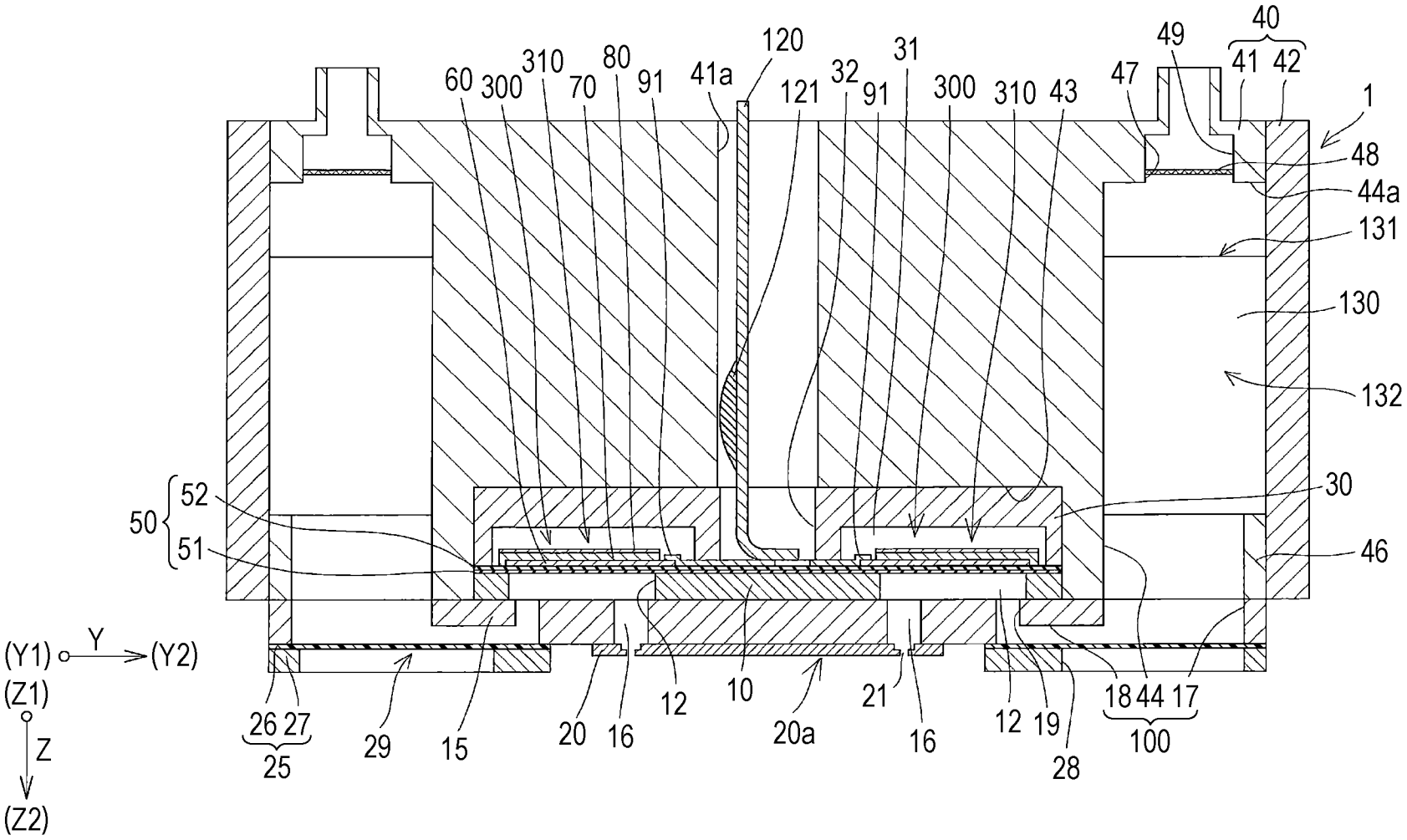
FIG. 4 is a cross-sectional view of the recording head according to the first embodiment of the invention.
Figure 5:
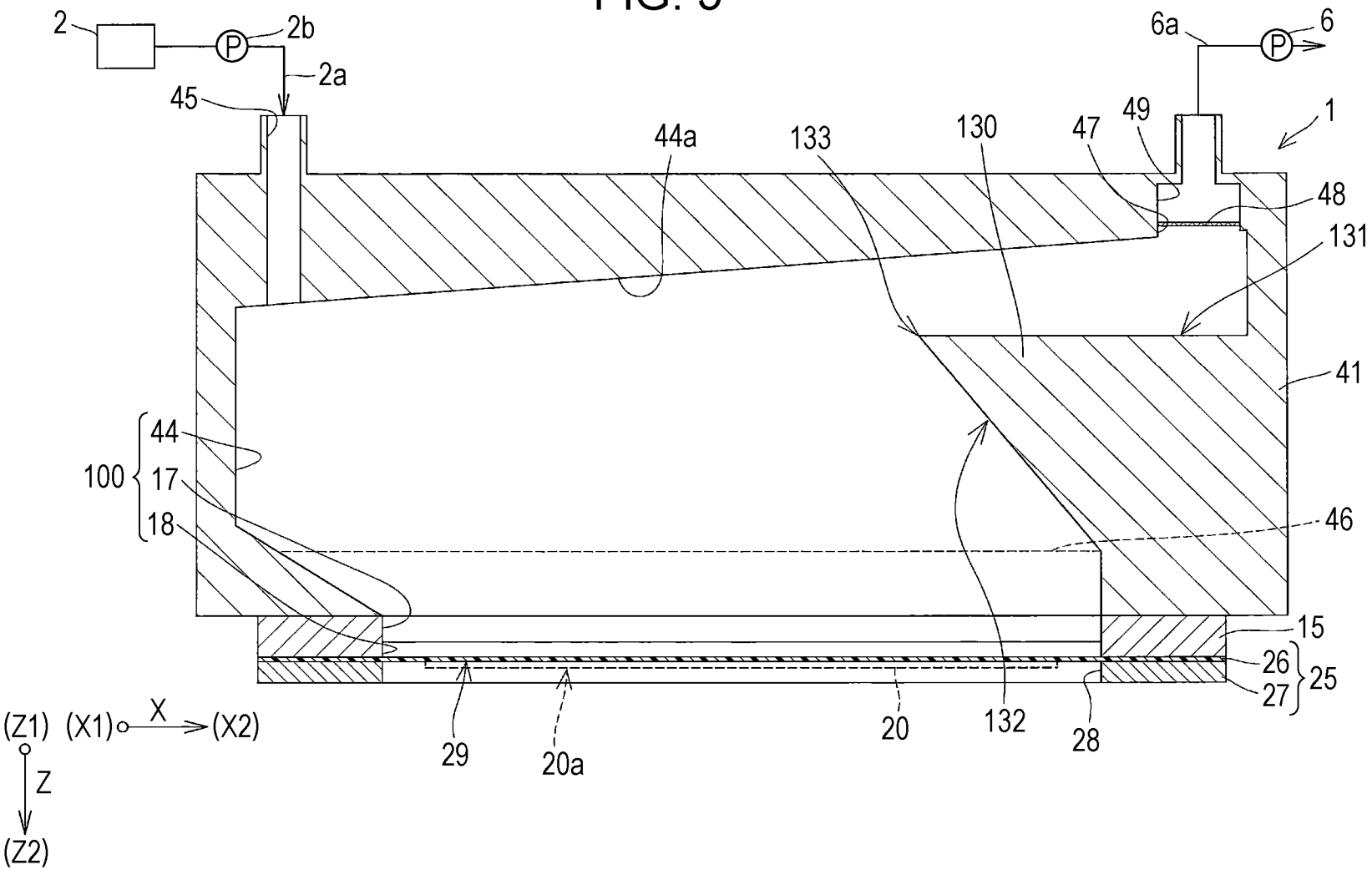
FIG. 5 is another cross-sectional view of the recording head according to the first embodiment of the invention.
Figure 6:
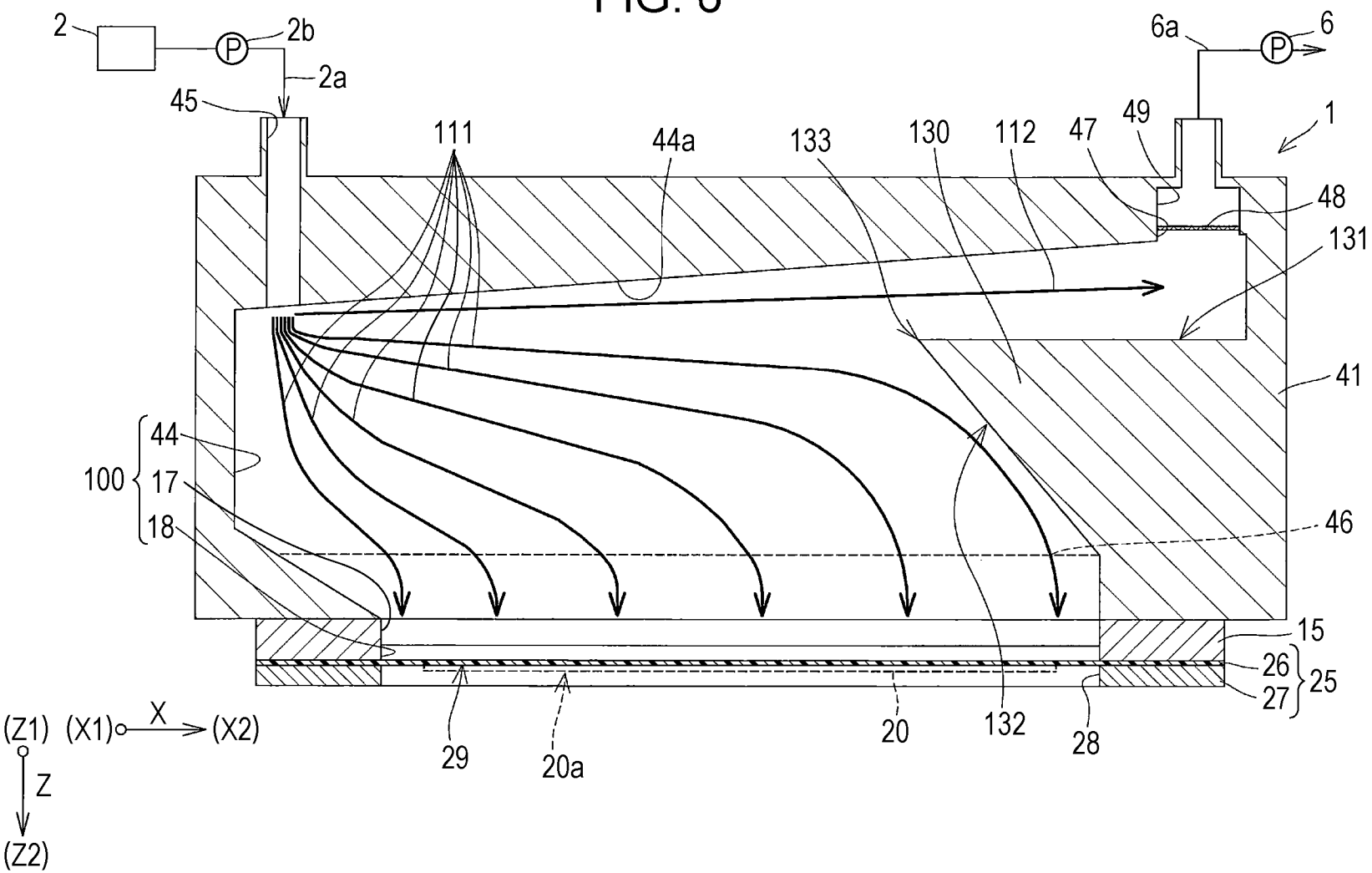
FIG. 6 is a cross-sectional view for explaining flow of ink in the recording head according to the first embodiment of the invention.

Referring now to FIG. 2 to FIG. 6, the recording head 1 mounted in the recording apparatus I according to this embodiment will be described in detail. FIG. 2 is an exploded perspective view of the ink jet recording head, exemplifying the recording head according to the first embodiment of the invention, FIG. 3 is a plan view of a flow path substrate and a communication plate, FIG. 4 is a cross-sectional view taken along a line IV-IV in FIG. 3, FIG. 5 is a cross-sectional view taken along a line V-V in FIG. 3, and FIG. 6 is a cross-sectional view for explaining the flow of the ink.

As shown in FIG. 2 and FIG. 4, a flow path substrate 10 included in the recording head 1, exemplifying the liquid ejecting head according to this embodiment, includes a plurality of pressure generating chambers 12, defined by a plurality of partition walls formed by anisotropic etching performed from one side, and aligned in the direction in which a plurality of nozzles 21 that each eject the ink are aligned. In this embodiment, the direction in which the pressure generating chambers 12 are aligned corresponds to the first direction X. In addition, the flow path substrate 10 includes a plurality of rows (two rows in this embodiment), each including the pressure generating chambers 12 aligned in the first direction X, the rows being aligned in the second direction Y. In this embodiment, the recording head 1 is oriented downward in the vertical direction, i.e., to the Z2-side in the third direction Z. Accordingly, the direction in which buoyancy is exerted corresponds to the direction from the Z2-side toward the Z1-side in the third direction Z.

On the Z2-side of the flow path substrate 10 in the third direction Z, a communication plate 15 and a nozzle plate 20 are sequentially stacked.

The communication plate 15 includes nozzle communication paths 16 each communicating between the pressure generating chamber 12 and the nozzle 21. The communication plate 15 is larger in area than the flow path substrate 10, and the nozzle plate 20 is smaller in area than the flow path substrate 10. Because of the presence of the communication plate 15, the nozzle 21 of the nozzle plate 20 and the pressure generating chamber 12 are located more distant from each other, and therefore the ink in the pressure generating chamber 12 becomes less susceptible to thickening of the ink in the vicinity of the nozzle 21 due to evaporation of moisture in the ink. In this embodiment, the surface of the nozzle plate 20, including the opening of the nozzle 21 from which the ink droplet is ejected, will be referred to as a nozzle surface 20*a*.

The communication plate 15 also includes a first manifold section 17 and a second manifold section 18 constituting a part of a manifold 100, serving as a common liquid chamber communicating with the nozzles 21 via the respective pressure generating chambers 12.

The first manifold section 17 is formed so as to penetrate through the communication plate 15 in the third direction Z.

The second manifold section 18 is formed as an opening in the surface of the communication plate 15 on the side of the nozzle plate 20, instead of penetrating through the communication plate 15 in the third direction Z.

Further, the communication plate 15 includes a plurality of supply communication paths 19, each independently communicating with an end portion of the corresponding pressure generating chamber 12, in the second direction Y. The supply communication path 19 communicates between the second manifold section 18 and the pressure generating chamber 12. In other words, the supply communication paths 19 are aligned in the first direction X, along the manifold 100.

The nozzle plate 20 includes a plurality of nozzles 21 respectively communicating with the pressure generating chambers 12 via the nozzle communication path 16. The nozzles 21 that eject the ink (liquid) of the same type are aligned in the first direction X, thus forming a nozzle row. Two of such rows of the nozzle 21 aligned in the first direction X are provided, in the second direction Y.

A vibration plate 50 is provided on the Z1-side of the flow path substrate 10, opposite to the communication plate 15. In this embodiment, the vibration plate 50 includes an elastic film 51 formed of silicon oxide and provided on the Z1-side of the flow path substrate 10, and an insulation film 52 formed of zirconium oxide and stacked on the elastic film 51. Here, the liquid flow paths of the pressure generating chamber 12 and of other components are formed by anisotropic etching performed on the flow path substrate 10 from the side to which the nozzle plate 20 is attached, and the other side of the pressure generating chamber 12 is defined by the elastic film 51.

In addition, a piezoelectric actuator 300 including a first electrode 60, a piezoelectric layer 70, and a second electrode 80 is provided on the vibration plate 50 of the flow path substrate 10. In this embodiment, the piezoelectric actuator 300 serves as the driving element that causes a pressure fluctuation to the ink in the pressure generating chamber 12. The first electrode 60 is divided for each of the pressure generating chambers 12, so as to constitute an individual electrode, independently corresponding to an active portion, the substantial driving portion of the piezoelectric actuator 300.

The piezoelectric layer 70 is formed so as to extend to an outer side of an end portion of the first electrode 60 on the side of the supply communication path 19. Thus, the end portion of the first electrode 60 on the side of the supply communication path 19 is covered with the piezoelectric layer 70.

The piezoelectric layer 70 is formed of a piezoelectric material of an oxide having a polarization structure, provided on the first electrode 60. Examples of such materials include a perovskite oxide expressed by a general formula of $ABO_3$, a lead-based piezoelectric material containing lead, and a lead-free piezoelectric material free from lead.

The piezoelectric layer 70 includes, as shown in FIG. 3, a plurality of recesses 71 each corresponding to the partition wall between the pressure generating chambers 12 adjacent to each other in the first direction X. The width of the recess 71 in the first direction X is generally the same as, or slightly wider than the width of the partition wall in the first direction. Accordingly, the rigidity of the portion of the vibration plate 50 corresponding to the end portion of the pressure generating chamber 12 in the second direction Y, i.e., the arm portion of the vibration plate 50, is limited, and therefore the piezoelectric actuator 300 can be effectively displaced.

The second electrode 80 is provided on the side of the piezoelectric layer 70 opposite to the first electrode 60, and constitutes a common electrode shared by a plurality of active portions. The second electrode 80 may, or may not be provided on an inner surface of the recess 71, i.e., on the inner side face of the recess 71 of the piezoelectric layer 70.

The piezoelectric actuator 300 composed of the first electrode 60, the piezoelectric layer 70, and the second electrode 80 configured as above is displaced when a voltage is applied between the first electrode 60 and the second electrode 80. In other words, upon applying a voltage between these electrodes, a piezoelectric strain is created in the piezoelectric layer 70 interposed between the first electrode 60 and the second electrode 80. The portion of the piezoelectric layer 70 where the piezoelectric strain is created when the voltage is applied between the electrodes will be referred to as an active portion 310. In contrast, the portion of the piezoelectric layer 70 where the piezoelectric strain is not created will be referred to as an inactive portion. Further, a portion in the active portion 310 of the piezoelectric layer 70, where the piezoelectric strain is created, opposing the pressure generating chamber 12 will be referred to as a flexible portion, and a portion opposing an outer region of the pressure generating chamber 12 will be referred to as an inflexible portion.

In this embodiment, all of the first electrode 60, the piezoelectric layer 70, and the second electrode 80 are formed so as to continuously extend in the second direction Y, as far as the outer region of the pressure generating chamber 12. In other words, the active portion 310 is continuously provided to the outer region of the pressure generating chamber 12. Accordingly, the portion of the active portion 310 of the piezoelectric actuator 300 opposing the pressure generating chamber 12 corresponds to the flexible portion, and the portion opposing the outer region of the pressure generating chamber 12 corresponds to the inflexible portion.

In addition, as shown in FIG. 3, an individual wiring 91 is drawn out as a leader line, from the first electrode 60 of the piezoelectric actuator 300. Likewise, a common wiring 92 is drawn out as a leader line from the second electrode 80. Further, a flexible cable 120 is connected to the individual wiring 91 and the common wiring 92. The flexible cable 120 is a flexible circuit board, on which a driving circuit 121 formed of a semiconductor element is mounted, in this embodiment.

In the piezoelectric actuator 300 according to this embodiment, the first electrode 60 serves as the individual electrode independently corresponding to the active portion 310, and the second electrode 80 serves as the common electrode shared by the plurality of active portions 310. Instead, the first electrode 60 may be set up as the common electrode, and the second electrode 80 may be set up as the individual electrode.

As shown in FIG. 4, a protection substrate 30 having generally the same size as the flow path substrate 10 is provided on the side of the flow path substrate 10 on which the piezoelectric actuator 300 is formed. The protection substrate 30 includes an enclosure portion 31, which is a space for protecting the piezoelectric actuator 300. Two of the enclosure portions 31 are provided side by side in the second direction Y, so as to correspond to the rows of the piezoelectric actuator 300 aligned in the first direction X. The protection substrate 30 also includes a through hole 32 formed in the third direction Z, at a position between the two enclosure portions 31 aligned in the second direction Y.

The respective end portions of the individual wiring 91 drawn out from the first electrode 60 of the piezoelectric actuator 300 and the common wiring 92 drawn out from the second electrode 80 (see FIG. 3) extend so as to be exposed in the through hole 32, and are electrically connected to the flexible cable 120 in the through hole 32.

On the Z1-side of the protection substrate 30 and the communication plate 15, a casing 40 is fixed. The casing 40 includes a casing main body 41 and a lid 42. The casing main body 41 has generally the same shape as the communication plate 15 in a plan view, and is joined to both of the protection substrate 30 and the communication plate 15. More specifically, the casing main body 41 includes a recess 43 formed on the side of the protection substrate 30, and having a depth that allows the flow path substrate 10 and the protection substrate 30 to be accommodated. Thus, the opening of the recess 43 on the side of the nozzle plate 20 is sealed with the communication plate 15, with the flow path substrate 10 and the protection substrate 30 accommodated in the recess 43.

The casing main body 41 also includes a connection hole **41*a* communicating with the through hole 32 formed in the communication plate 15, and provided for the flexible cable 120** to be inserted.

The casing main body 41 further includes third manifold sections 44 located on the respective sides of the recess 43 in the second direction Y, and having an opening oriented to the communication plate 15 in the third direction Z and to the side face in the second direction Y. The opening of the third manifold section 44 oriented in the second direction Y is sealed with the lid 42. More specifically, a wall portion 46 that closes the opening on the Z2-side, i.e., on the side of the communication plate 15, is provided on the opening of the third manifold section 44 in the casing main body 41 oriented in the second direction Y. The lid 42 is joined to the wall portion 46, so that the opening of the third manifold section 44 oriented in the second direction Y is sealed. Providing thus the wall portion 46 allows the manifold 100 to be sealed, simply by joining the two elements, namely the communication plate 15 and the casing main body 41. Accordingly, unevenness in joining originating from the size tolerance of the casing main body 41, the lid 42, and the communication plate 15 can be suppressed, and hence the leakage of the link can be prevented. In the case where the wall portion 46 is not provided, the three elements, namely the lid 42, the casing main body 41, and the communication plate 15 have to be joined in order to seal the manifold 100, in which case the manifold 100 may fail to be completely sealed depending on the size tolerance of the parts, and the ink may leak to outside. Further, though not shown, the wall portion 46 may be reinforced with a rib provided inside the third manifold section 44, more particularly a rib connecting between the wall portion 46 and the inner wall surface of the third manifold section 44 opposing the wall portion 46. A single piece of rib, or a plurality of ribs, located at predetermined intervals in the first direction X, may be provided.

The third manifold section 44 provided in the casing 40 communicates with the first manifold section 17 via the opening on the Z2-side, i.e., the side of the communication plate 15. Accordingly, the third manifold section 44 provided in the casing 40, and the first manifold section 17 and the second manifold section 18 provided in the communication plate 15 constitute the manifold 100, serving as the common liquid chamber according to this embodiment. Thus, the flow path member including the manifold 100 according to this embodiment refers to the structure including the flow path substrate 10, the communication plate 15, and the casing 40. In addition, as described above, the second manifold section 18 at the lowermost position on the Z2-side in the manifold 100 communicates with the pressure generating chamber 12 via the supply communication path 19. In other words, the Z2-side of the manifold 100 in the third direction Z communicates with the pressure generating chamber 12. Here, the manifold 100 is provided on both sides of the casing 40 in the second direction Y as described above, and the two manifolds 100 on the respective sides of the casing 40 in the second direction Y are independent from each other, without communicating with each other. The manifolds 100 each communicate with the corresponding row of the pressure generating chambers 12 aligned in the first direction X.

As shown in FIG. 5, the casing main body 41 also includes supply ports 45 communicating with the respective manifolds 100, to supply the ink thereto. The supply port 45 is open toward the Z1-side, opposite to the communication plate 15 of the casing main body 41, in the third direction Z. The supply port 45 is located at a position communicating with the X1-side, corresponding to an end portion of the third manifold section 44 in the first direction X. Thus, the supply port 45 has an opening in the inner wall of the manifold 100.

Further, the casing main body 41 includes a discharge port 47 communicating with the manifold 100, for discharging air bubbles in the manifold 100. In this embodiment, the discharge port 47 communicates with the Z1-side of the third manifold section 44 in the third direction Z. In addition, the discharge port 47 is located on the X2-side, opposite to the end portion of the third manifold section 44 in the first direction X, where the supply port 45 is provided.

In this embodiment, the third manifold section 44 is formed such that the width on the Z1-side in the third direction Z, taken in the first direction X, is wider than the width on the Z2-side communicating with the nozzle 21. The width of the first manifold section 17 is generally the same as the width of the third manifold section 44 on the Z1-side, taken in the first direction X. Increasing thus the width of the third manifold section 44 on the Z1-side taken in the first direction X allows a sufficient overall volume of the manifold 100 to be secured, to thereby secure sufficient ink supply capacity, as well as the absorption capacity of the pressure fluctuation that takes place upon ejecting the ink. Further, in this embodiment, the supply port 45 is located on the outer side of the end portion of the first manifold section 17 on the X1-side, on the Z1-side of the third manifold section 44. Likewise, the discharge port 47 is located on the outer side of the end portion of the first manifold section 17 on the X2-side, on the Z1-side of the third manifold section 44. Thus, the discharge port 47 is located on the outer side of the plurality of pressure generating chambers 12, in the first direction X in which the pressure generating chambers 12 are aligned. In other words, the discharge port 47 is located, in a plan view in the third direction Z, at a position deviated from the region where the plurality of pressure generating chambers 12 are formed in the first direction X. Locating thus the discharge port 47 on the outer side of the pressure generating chamber 12 allows the discharge port 47 to be far enough from the pressure generating chamber 12, thereby preventing the air bubbles that have gathered in the vicinity of the discharge port 47, and the ink residing right under the discharge port 47, in other words the ink with the characteristics changed owing to precipitation of the components as result of stagnating, from being introduced into the pressure generating chamber 12.

A ceiling 44*a* of the third manifold section 44 formed in the casing 40 includes a sloped surface formed so as to be farther from the nozzle surface 20*a*, toward the discharge port 47. In other words, the ceiling 44*a* of the third manifold section 44 is becoming higher from the X1-side where the supply port 45 is provided toward the X2-side where the discharge port 47 is provided, in the first direction X in which the pressure generating chambers 12 are aligned. Here, the ceiling 44*a* of the third manifold section 44 refers to the inner wall surface on the upper side in the vertical direction, in which buoyancy is exerted, in other words in which the air bubbles contained in the ink move upward. In this embodiment, the ceiling 44*a* corresponds to the inner wall surface of the third manifold section 44 on the Z1-side opposite to the communication plate 15, in the third direction Z. Further, since the nozzle surface 20*a* is oriented along a plane including the first direction X and the second direction Y in this embodiment, the state that the ceiling 44*a* is high means the state that the distance from the nozzle surface 20*a* is long. In this embodiment, in addition, the ceiling 44*a* is formed as a sloped surface such that the height from the nozzle surface 20*a* in the third direction Z gradually and continuously increases in the first direction X, from the X1-side toward the X2-side. Naturally, the sloped surface may be formed in a part of the ceiling 44*a*, or intermittently formed in some parts of the ceiling 44*a*.

Increasing thus the height of the ceiling 44*a* of the third manifold section 44, i.e., the ceiling 44*a* of the manifold 100, from the X1-side where the supply port 45 is provided toward the X2-side on the opposite side, allows the air bubbles, contained in the ink supplied into the manifold 100 through the supply port 45, to be gathered and stored in the region in the manifold 100 where the ceiling 44*a* is higher, on the X2-side. Accordingly, the air bubbles contained in the ink can be prevented from intruding into the pressure generating chamber 12, and hence inadequate ejection of the ink droplet can be prevented. More specifically, since the ink is supplied to the pressure generating chamber 12 from the Z2-side of the manifold 100, collecting the air bubbles on the Z1-side, opposite to the Z2-side where the ink is supplied to the pressure generating chamber 12, effectively prevents the collected air bubbles from intruding into the pressure generating chamber 12.

Here, although in this embodiment the nozzle surface 20*a* extends in the first direction X, and the manifold 100 is formed such that the height of the ceiling 44*a* from the nozzle surface 20*a* in the third direction Z becomes higher on the side of the discharge port 47 than on the side of the supply port 45, in the first direction X, different configurations may be adopted. For example, when the distance between the nozzle surface 20*a* and the ceiling 44*a* is the same on the X1-side where the supply port 45 is provided and on the X2-side where the discharge port 47 is provided, disposing the nozzle surface 20*a* such that the X2-side in the first direction X becomes higher in the vertical direction makes the ceiling 44*a* a sloped surface which is higher on the side of the discharge port 47 in the vertical direction, than on the side of the supply port 45. Since the ceiling 44*a* serves to facilitate the air bubbles moving upward owing to the buoyancy effect to migrate toward the discharge port 47 along the ceiling 44*a*, it suffices that the ceiling 44*a* includes a sloped surface oriented such that the side of the discharge port 47 is higher than the side of the supply port 45 in the vertical direction, when the recording head 1 is in use.

The casing 40 also includes a degassing chamber 49 communicating with the discharge port 47 via a gas-liquid separation wall 48. The gas-liquid separation wall 48 is a gas-permeable film that transmits gas (air) but not a liquid such as the ink, for example formed of a known polymer. The degassing chamber 49 is connected to the depressurizing device provided in the ink jet recording apparatus I as described earlier, and maintained in the depressurized state. Accordingly, the air bubbles collected toward the discharge port 47 along the ceiling 44*a* reach the gas-liquid separation wall 48 by moving upward owing to the buoyancy effect, and are transmitted through the gas-liquid separation wall 48 thus to be discharged to the degassing chamber 49. Thus, the air bubbles mixed in the ink are separated.

Although the casing 40 includes the gas-liquid separation wall 48 and the degassing chamber 49 in this embodiment, the degassing chamber 49 including the gas-liquid separation wall 48 may be provided in a component other than the casing 40. In addition, although in this embodiment the discharge port 47 communicates with the degassing chamber 49 including the gas-liquid separation wall 48, the ink containing the air bubbles may be discharged through the discharge port 47, and the discharged ink may be made to circulate so as to be again supplied into the manifold 100 through the supply port.

The third manifold section 44 includes a wall 130. The wall 130 continuously extend from the inner wall of the third manifold section 44 on the X2-side, along the ceiling 44*a* so as to oppose the discharge port 47 in the third direction Z, which is the vertical direction. In this embodiment, the wall 130 includes a floor surface 131 opposing the ceiling 44*a*. Accordingly, the floor surface 131 of the wall 130 is the surface of the wall 130 on the Z1-side opposing the ceiling 44*a* in the third direction Z, and extending along the ceiling 44*a*, i.e., in the first direction X, so as to oppose the discharge port 47 in the third direction Z. In this embodiment, the floor surface 131 extends in the first direction X, without being inclined with respect to the first direction X. As described above, the floor surface 131 is opposed to the discharge port 47 in the third direction Z. Accordingly, the floor surface 131 of the wall 130 and the discharge port 47 are located so as to overlap, in a plan view in the third direction Z.

The wall 130 configured as above generates, from the ink supplied into the manifold 100 through the supply port 45, a first flow 111 directed to the plurality of pressure generating chambers 12 (curved arrows in FIG. 6), and a second flow 112 directed to the discharge port 47 (straight arrow in FIG. 6). A part of the ink flowing toward the wall 130 from the supply port 45 is guided by a surface 132 of the wall 130 oriented to the X1-side in the first direction X, which is the side of the supply port 45, so that the first flow 111 directed to the plurality of pressure generating chambers 12 along the surface 132 of the wall 130 is generated. At the same time, another part of the ink flowing toward the wall 130 from the supply port 45 constitutes the second flow 112 directed to the discharge port 47, between the floor surface 131 of the wall 130 and the ceiling 44*a*.

In this embodiment, the portion of the wall 130 that generates the first flow 111, in other words the surface 132 of the wall 130 oriented to the X1-side in the first direction X, includes a sloped surface formed so as to be closer to the nozzle surface 20*a* in a direction away from the supply port 45, i.e., in the direction toward the X2-side in the first direction X. Thus, the surface 132 on the X1-side of the wall 130 includes the sloped surface inclined toward the Z2-side in the third direction Z. In this embodiment, the entire region of the surface 132 of the wall 130 oriented to the X1-side corresponds to the sloped surface. Naturally, the sloped surface may be formed in a part of the surface 132 of the wall 130 oriented to the X1-side.

Forming thus the surface 132 of the wall 130 oriented to the X1-side so as to include the sloped surface facilitates the first flow 111 of the ink to flow along the surface 132, thereby preventing the ink constituting the first flow 111 from stagnating.

In addition, the boundary between the floor surface 131 of the wall 130 and the surface 132 oriented to the X1-side is formed in a pointed shape projecting toward the X1-side from the X2-side. The tip portion of the wall 130 projecting toward the X1-side, on the side of the supply port 45, serves to branch the flow of the ink into the first flow 111 directed to the plurality of pressure generating chambers 12 from the supply port 45, and the second flow 112 directed to the discharge port 47 from the supply port 45.

Providing thus the wall 130 in the manifold 100, so as to generate the first flow 111 directed to the plurality of pressure generating chambers 12 and the second flow 112 directed to the discharge port 47, from the ink supplied into the manifold 100 through the supply port 45, reduces the region in the manifold 100 where the ink flow stagnates. In other words, the wall 130 is provided in the position in the manifold 100 where the ink flow is prone to stagnate. Therefore, the region in the manifold 100 where the ink flow stagnates can be reduced, and precipitation of the components of the ink due to the stagnation of the ink can be prevented, which further leads to prevention of the ink having the characteristics changed owing to the precipitation of the components, from being introduced into the pressure generating chamber 12. Further, even though the components of the ink in the vicinity of the discharge port 47, in other words the ink located between the floor surface 131 of the wall 130 and the ceiling 44*a*, precipitate and provoke a change in characteristics, the wall 130 serves to minimize the contact between the ink with the changed characteristics between the wall 130 and the ceiling 44*a*, and the first flow 111 directed to the plurality of pressure generating chambers 12. Therefore, the ink with the changed characteristics between the wall 130 and the ceiling 44*a*, and the ink constituting the first flow 111 directed to the plurality of pressure generating chambers 12 can be prevented from being mixed with each other, and consequently the ink with the changed characteristics can be prevented from flowing toward the nozzle 21.

In the case where the wall 130 is not provided, although the first flow 111 directed to the plurality of pressure generating chambers 12 from the supply port 45, and the second flow 112 directed to the discharge port 47 from the supply port 45 along the ceiling 44*a* are generated, the ink flow stagnates in a region beyond the position where the ink flow is branched into the first flow 111 and the second flow 112, i.e., on the X2-side in the manifold 100. In this region where the ink flow stagnates the components of the ink precipitate, and the ink of different characteristics and the fresh ink supplied into the manifold 100 and constituting the first flow 111 are mixed with each other. When such mixture of the ink is introduced into the pressure generating chambers 12, uneven printing result and degradation in ejection stability may be incurred. In particular, the ink in the region where the ink flow has stagnated often fails to be replaced during the printing job performed after the ink is sucked by the suction device from the nozzle 21, and thus the uneven printing result and degradation in ejection stability are prone to be incurred. With the configuration according to this embodiment, however, the wall 130 serves to reduce the region where the ink flow is prone to stagnate, regardless that the cleaning operation has been performed with the suction device, and to minimize the contact between the ink with the changed characteristics and the ink constituting the first flow 111, thereby preventing the ink with the changed characteristics from being introduced into the pressure generating chamber 12.

Here, it is preferable that the tip portion 133 of the wall 130, which branches the ink flow into the first flow 111 and the second flow 112, is located on the upper side from the center of the manifold 100 in the third direction Z, in which the ceiling 44*a* and the portion of the manifold 100 communicating with the pressure generating chamber 12, i.e., the end portion of the manifold 100 on the Z2-side, oppose each other. Such a position can also be expressed as the Z1-side in the manifold 100, closer to the ceiling 44*a*. In this case, the region in the manifold 100 where the ink flow is prone to stagnate, i.e., the region between the wall 130 and the ceiling 44*a*, can be located on the Z1-side. Therefore, even though the first flow 111 brings the ink with the changed characteristics located between the wall 130 and the ceiling 44*a* toward the pressure generating chamber 12, the ink with the changed characteristics can be sufficiently diffused inside the manifold 100 before reaching the pressure generating chamber 12. Thus, the ink with the characteristics changed owing to residing between the wall 130 and the ceiling 44*a* is located far enough from the position close to the pressure generating chamber 12, i.e., the end portion of the manifold 100 on the Z2-side, and therefore even though the ink with the changed characteristics flows toward the pressure generating chamber 12, the ink with the changed characteristics is sufficiently diffused inside the manifold 100, before reaching the pressure generating chamber 12. Consequently, the ink with the changed characteristics can be prevented from being introduced into the pressure generating chamber 12, and the uneven printing result and degradation in ejection stability can be avoided.

Here, the air bubbles contained in the ink supplied into the manifold 100 move up toward the ceiling 44*a*, owing to the buoyancy effect. In this embodiment, since the ceiling 44*a* is formed as the sloped surface inclined upward to the Z1-side, toward the X2-side on which the discharge port 47 is provided, from the X1-side on which the supply port 45 is provided, the air bubbles that have moved upward to the ceiling 44*a* owing to the buoyancy effect migrate toward the discharge port 47 along the ceiling 44*a*. In addition, since the second flow 112 is generated between the floor surface 131 of the wall 130 and the ceiling 44*a* in this embodiment, the air bubbles that have moved up toward the ceiling 44*a* are made to migrate by the second flow 112 toward the discharge port 47. Here, although the ceiling 44*a* according to this embodiment is formed as the sloped surface, such that the portion on the side of the discharge port 47 is on the upper side in the vertical direction, with respect to the portion on the side of the supply port 45, different configurations may be adopted because, for example, even when the ceiling 44*a* is horizontal unlike in this embodiment, the air bubbles can still migrate toward the discharge port 47, because the wall 130 generates the second flow 112. Naturally, forming the sloped surface in the ceiling 44*a* further facilitates the air bubbles to migrate toward the discharge port 47, compared with the case where the ceiling 44*a* is horizontal.

Further, a compliance substrate 25 is provided on the surface of the communication plate 15 on the side of the opening of the first manifold section 17 and the second manifold section 18. The compliance substrate 25 seals the opening of the first manifold section 17 and the second manifold section 18 on the side of the nozzle surface 20*a*. In this embodiment, the compliance substrate 25 includes a sealing layer 26 formed of a flexible film, and a fixed substrate 27 formed of a hard material such as a metal. A region of the fixed substrate 27 opposing the manifold 100 is formed into an opening 28 by completely removing the substrate material in the thickness direction, and therefore the corresponding side of the manifold 100 constitutes a compliance portion 29, which is a flexible portion sealed only by the flexible sealing layer 26.

As described thus far, in this embodiment, the manifold 100 includes the wall 130 continuously extending from the inner wall of the manifold 100, and including the floor surface 131 extending along the ceiling 44*a*. Accordingly, the ink supplied through the supply port 45 is branched by the wall 130 into the first flow 111 directed to the plurality of pressure generating chambers 12 and the second flow 112 directed to the discharge port 47 through between the wall 130 and the ceiling 44*a*. Thus, the wall 130 is located at the position where the ink flow is prone to stagnate, and therefore the region where the ink flow is prone to stagnate is reduced, so that the ink with the characteristics changed owing to the stagnated flow can be prevented from being introduced into the plurality of pressure generating chambers 12. In addition, the contact between the ink with the characteristics changed, owing to precipitation of the components provoked because of the ink residing between the wall 130 and the ceiling 44*a*, and the ink constituting the first flow 111 can be minimized, so that the ink with the changed characteristics is prevented from being introduced into the pressure generating chamber 12.

The ceiling 44*a* of the manifold 100 includes the sloped surface formed so as to be farther from the nozzle surface 20*a* toward the discharge port 47. Accordingly, the air bubbles that have moved upward owing to the buoyancy effect are facilitated to migrate toward the discharge port 47 along the sloped surface of the ceiling 44*a*, thus to be accommodated in the region right under the discharge port 47. Therefore, the air bubbles can be prevented from intruding into the pressure generating chamber 12, and a malfunction such as inadequate ejection, originating from the intrusion of the air bubbles into the pressure generating chamber 12, can be prevented.

Although the sloped surface is formed over the entirety of the ceiling 44*a* in the first direction X in this embodiment, a part of the ceiling 44*a*, or a plurality of portions thereof, may be formed as the sloped surface. Provided that the ceiling 44*a* includes the sloped surface, the sloped surface may be formed partially or all over.

Alternatively, the ceiling 44*a* may be formed in a stepped shape, such that the X1-side is lower and the X2-side is higher.

Although the sloped surface is formed in the ceiling 44*a* in this embodiment, it is not mandatory that the ceiling 44*a* includes the sloped surface. The second flow 112 is generated between the ceiling 44*a* and the floor surface 131 of the wall 130, regardless of whether the ceiling 44*a* includes the sloped surface, and therefore the air bubbles that have moved up toward the ceiling 44*a* are made to migrate toward the discharge port 47, by the second flow 112.

In this embodiment, the supply port 45 is provided in the ceiling 44*a* of the manifold 100, and the wall 130 generates, inside the manifold 100, the first flow 111 directed to the plurality of pressure generating chambers 1 from the supply port 45, and the second flow 112 directed to the discharge port 47 from the supply port 45. Further, the portion of the wall 130 that generates the first flow 111, in other words the surface 132 oriented to the X1-side on which the supply port 45 is provided, includes the sloped surface formed so as to be closer to the nozzle surface 20*a* in a direction away from the supply port 45.

Forming thus the surface 132 of the wall 130 as the sloped surface facilitates the first flow 111 of the ink to proceed along the surface 132, thereby preventing the first flow 111 from stagnating.

Although the sloped surface is formed over generally the entirety of the surface 132 of the wall 130 in this embodiment, a part of the surface 132 of the wall 130 may be formed as the sloped surface. In particular, it is preferable to form the sloped surface in the vicinity of the tip portion 133 of the wall 130 where the ink flow is branched into the first flow 111 and the second flow 112. In this case, the stagnation of the ink can be effectively prevented, because the ink flow is particularly prone to stagnate at the branch point between the first flow 111 and the second flow 112.

Here, the surface 132 of the wall 130 may be formed so as to extend along the third direction Z, instead of as the sloped surface. In the case where the surface 132 of the wall 130 is formed along the third direction Z, however, the ink flow is prone to stagnate at the branch point between the first flow 111 and the second flow 112, i.e., the Z1-side on the X1-side of the wall 130, compared with the case where the surface 132 includes the sloped surface.

In this embodiment, the tip portion 133 of the wall 130 projecting toward the branch point between the first flow 111 and the second flow 112, i.e., toward the X1-side, is located on the upper side of the center of the manifold 100 in the third direction Z, in which the ceiling 44*a* and the portion of the manifold 100 communicating with the pressure generating chamber 12 oppose each other. Therefore, the region where the ink flow stagnates between the wall 130 and the ceiling 44*a* can be located more distant from the pressure generating chamber 12, and the ink with the characteristics changed, owing to precipitation of the components as result of stagnation of the ink flow, can be prevented from being introduced into the pressure generating chamber 12.

Here, the tip portion 133 of the wall 130 may be located in a region on the Z2-side from the center between the ceiling 44*a* and the end portion of the manifold 100 on the Z2-side communicating with the pressure generating chamber 12, including the mentioned center.

The discharge port 47 is located on the outer side of the pressure generating chamber 12, in the first direction X in which the pressure generating chambers 12 are aligned. Locating thus the discharge port 47 on the outer side of the pressure generating chamber 12 allows the discharge port 47 to be far enough from the pressure generating chamber 12, thereby preventing the air bubbles that have gathered in the vicinity of the discharge port 47, and the ink residing right under the discharge port 47, in other words the ink with the characteristics changed owing to precipitation of the components as result of stagnating, from being introduced into the pressure generating chamber 12.

As a matter of course, the discharge port 47 may be located inside the region where the pressure generating chambers 12 are located, in the first direction X, in other words at a position overlapping the region where the pressure generating chambers 12 are located, in a plan view in the third direction Z.

Further, the discharge port 47 communicates with the degassing chamber 49 that includes the gas-liquid separation wall 48. Since the discharge port 47 communicates with the degassing chamber 49 including the gas-liquid separation wall 48, only the air bubbles that have gathered to the discharge port 47 can be discharged through the gas-liquid separation wall 48 and the degassing chamber 49, and therefore the air bubbles in the manifold 100 can be prevented from intruding into the pressure generating chamber 12.

It is not mandatory that the discharge port 47 communicates with the degassing chamber 49, and the air bubbles may be periodically discharged together with the ink.

Second Embodiment

Figure 7:
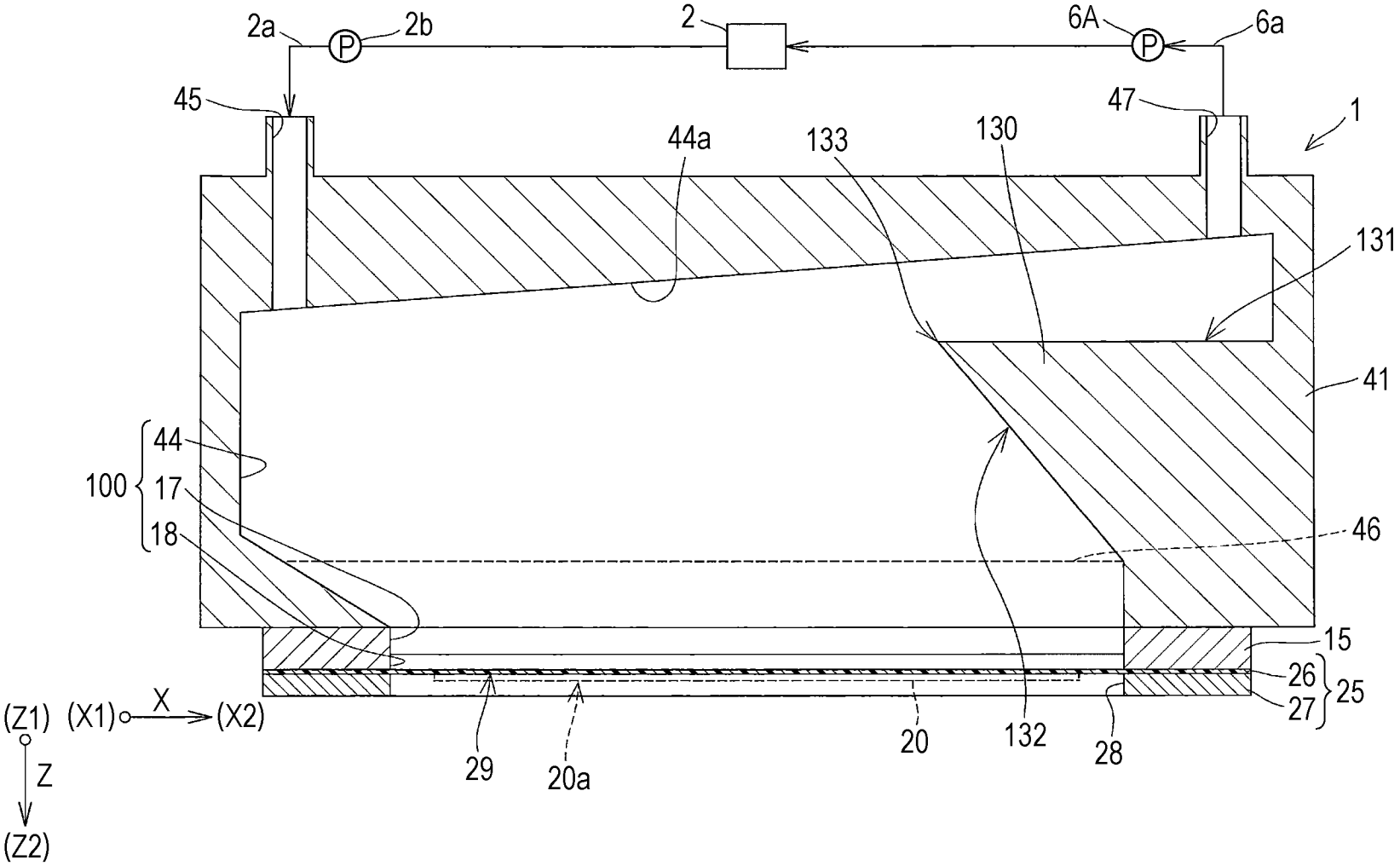
FIG. 7 is a cross-sectional view of a recording head according to a second embodiment of the invention, for explaining a flow path configuration.

FIG. 7 is a cross-sectional view of an ink jet recording head exemplifying a liquid ejecting head according to a second embodiment of the invention, and showing a flow path configuration of the liquid ejecting apparatus. The same elements as those of the foregoing embodiment are given the same numeral, and the description thereof will not be repeated.

As shown in FIG. 7, the recording head 1 is without the gas-liquid separation wall 48 and the degassing chamber 49 according to the first embodiment, and the discharge port 47 is formed as an opening.

The storage device 2 is connected to the discharge port 47, via the discharge pipe 6*a* such as a tube. In addition, a suction pump 6A, for example a vacuum pump for sucking the ink through the discharge port 47 is connected to halfway of the discharge pipe 6*a*, so that the ink in the manifold 100 is returned to the storage device 2 through the discharge port 47, by the suction pump 6A. Thus, the ink in the storage device 2 is made to circulate between the storage device 2 and the manifold 100 of the recording head 1, in this embodiment.

Hereunder, a cleaning method of the recording head 1 according to this embodiment will be described. The cleaning method according to this embodiment includes discharging the ink from the nozzle 21, when the suction pump 6A discharges the ink in the manifold 100 together with the air bubbles, through the discharge port 47. To discharge the ink from the nozzle 21, for example the suction device 9 shown in FIG. 1 is employed. Thus, the suction device 9 sucks the ink from the nozzle 21 together with the air bubbles, and discharges the same. Here, instead of utilizing the suction device 9, the ink may be discharged from the nozzle 21, for example, by driving the piezoelectric actuator 300.

When the ink is discharged together with the air bubbles through the discharge port 47 as above, the ink flow stagnates in the vicinity of the surface 132 of the wall 130 oriented to the X1-side. In this embodiment, the ink is discharged also from the nozzle 21 when the ink is discharged through the discharge port 47, and therefore the stagnation of the ink flow in the vicinity of the surface 132 of the wall 130, provoked by discharging the ink through the discharge port 47, can be prevented.

Although the circulation path is formed by connecting the discharge port 47 to the storage device 2 via the discharge pipe 6*a* in this embodiment, such a configuration is not mandatory. The ink discharged through the discharge port 47 may be discarded, instead of being returned to the storage device 2.

Third Embodiment

Figure 8:
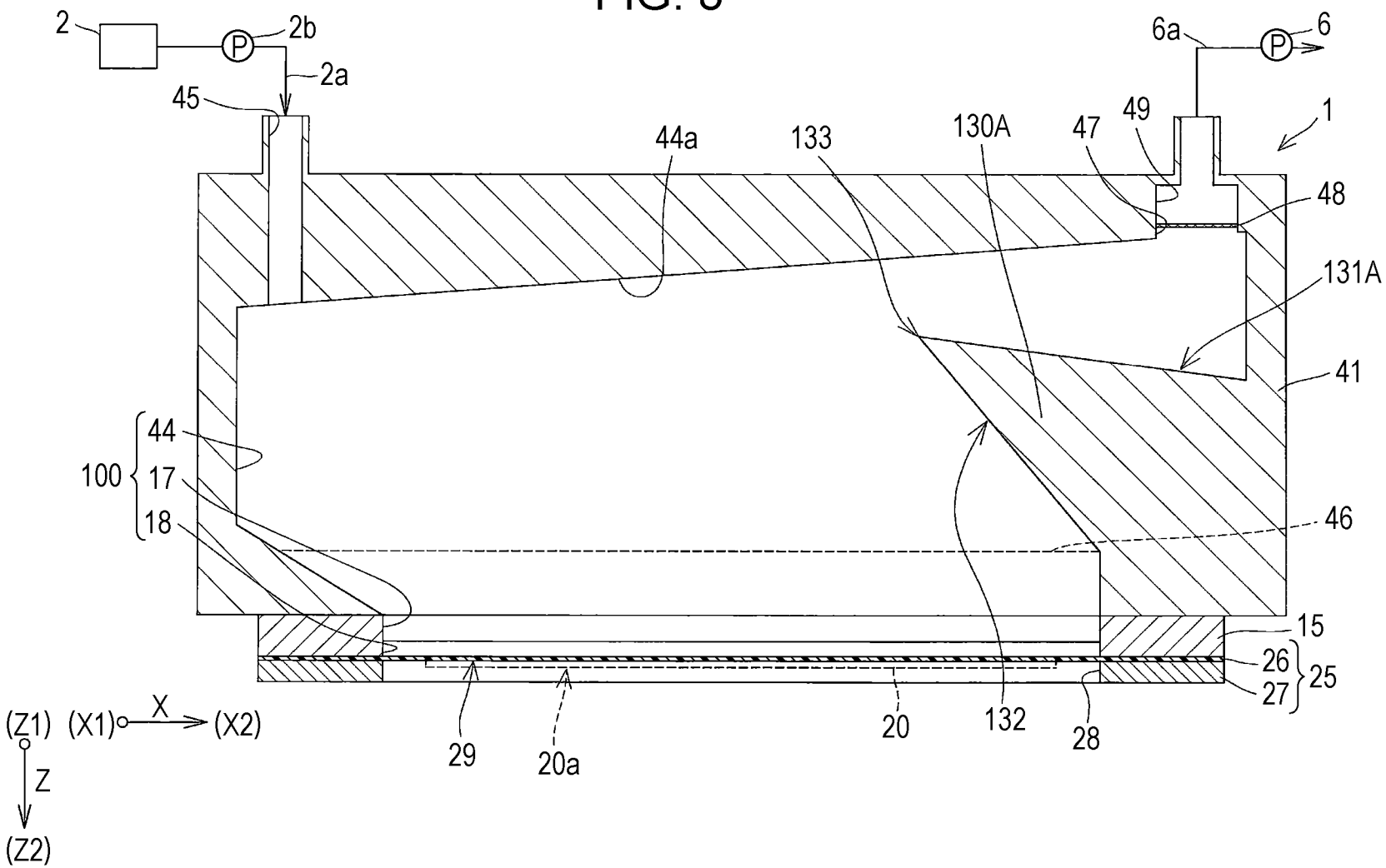
FIG. 8 is a cross-sectional view of a recording head according to a third embodiment of the invention.

FIG. 8 is a cross-sectional view of an ink jet recording head exemplifying a liquid ejecting head according to a third embodiment of the invention, and showing a flow path configuration of the liquid ejecting apparatus. The same elements as those of the foregoing embodiment are given the same numeral, and the description thereof will not be repeated.

As shown in FIG. 8, the third manifold section 44 of the casing 40 constituting the recording head 1 includes a wall 130A.

A floor surface 131A of the wall 130A opposing the ceiling 44*a* is formed so as to be closer to the nozzle surface 20*a*, toward the discharge port 47. In this embodiment, the floor surface 131A is formed as a sloped surface that gradually and continuously comes closer to the nozzle surface 20*a*, in the direction toward the discharge port 47 in the first direction X, i.e., toward the X2-side.

Forming thus the floor surface 131A so as to be closer to the nozzle surface 20*a* toward the discharge port 47 prevents the ink with the characteristics changed, owing to precipitation of the components as result of residing between the floor surface 131A and the ceiling 44*a*, from flowing out toward the pressure generating chamber 12. To be more detailed, the components of the ink residing between the floor surface 131A and the ceiling 44*a* migrate to the X2-side along the floor surface 131A, which is a sloped surface, and reside on the X2-side. Accordingly, the ink with the characteristics changed owing to residing between the floor surface 131A and the ceiling 44*a* is located farther from the first flow 111 (see FIG. 6), and therefore the ink of different characteristics is more effectively prevented from being introduced into the pressure generating chamber 12.

In this embodiment, the surface 132 of the wall 130 oriented to the X1-side in the first direction X includes a sloped surface formed so as to be closer to the nozzle surface 20*a* in the direction away from the supply port 45, i.e., toward the X2-side in the first direction X.

Forming thus the sloped surface in the surface 132 of the wall 130 facilitates the first flow 111 of the ink to flow along the surface 132, thereby preventing the first flow 111 from stagnating.

Figure 9:
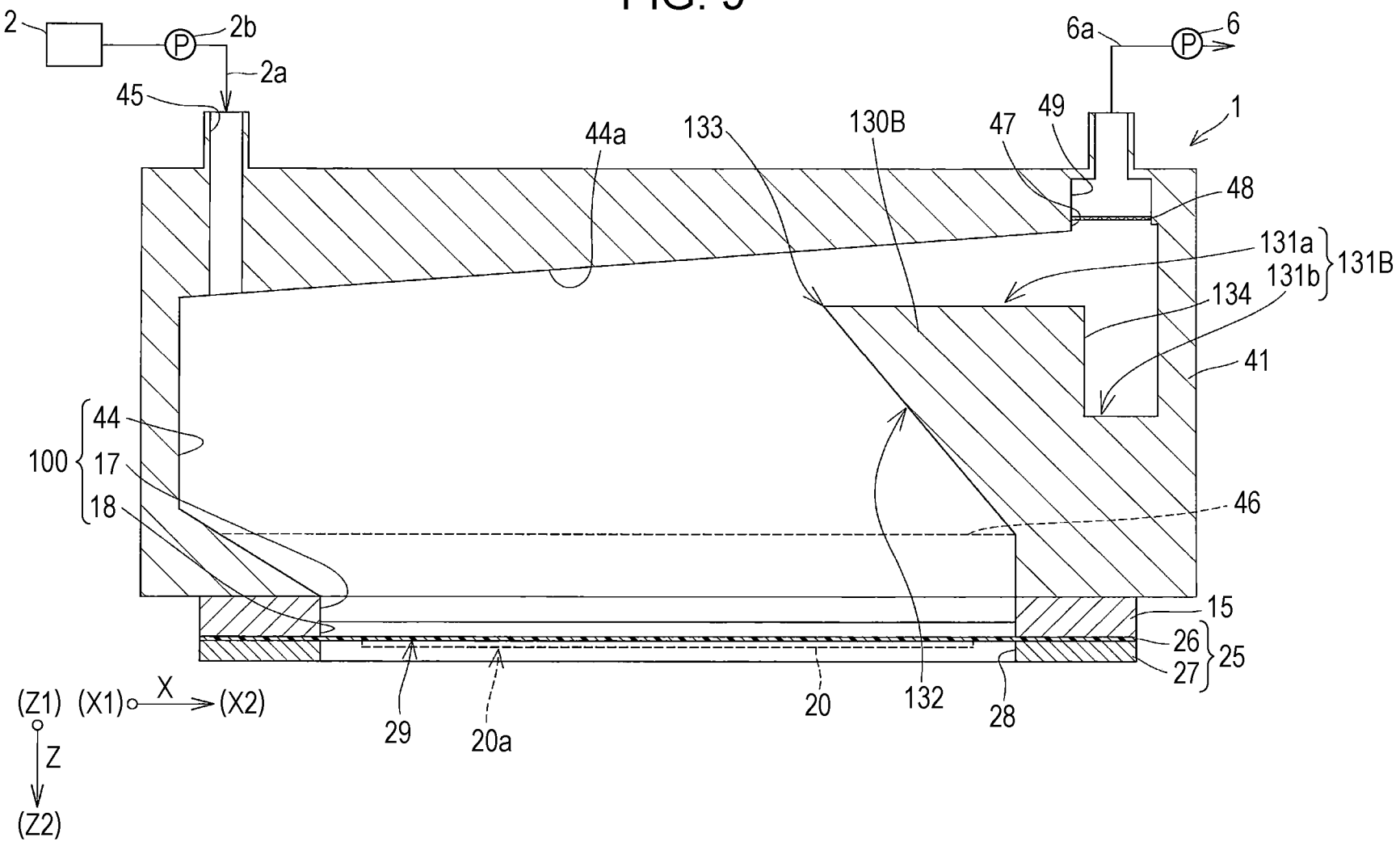
FIG. 9 is a cross-sectional view of a wall according to a variation of the third embodiment of the invention.

Here, it suffices that the floor surface 131A is formed so as to be closer to the nozzle surface 20*a*, toward the discharge port 47, and it is not mandatory that the floor surface 131A comes continuously closer to the nozzle surface 20*a*. For example, the floor surface 131A may be formed in a stepped shape, such that the height in the third direction Z from the nozzle surface 20*a* is higher on the side of the supply port 45, and the height in the third direction Z from the nozzle surface 20*a* is lower on the side of the discharge port 47, as shown in FIG. 9. FIG. 9 is a cross-sectional view of the ink jet recording head, showing a variation of the wall and a flow path configuration of the liquid ejecting apparatus.

As shown in FIG. 9, the wall 130B includes a recess 134 open toward the ceiling 44*a*, i.e., toward the Z1-side, and a floor surface 131B extending along the ceiling 44*a* and opposed thereto includes a first floor surface 131*a* extending from the opening of the recess 134, and a second floor surface 131*b* corresponding to the bottom surface of the recess 134 on the Z2-side. With such a configuration also, the floor surface 131B comes closer to the nozzle surface 20*a*, in the direction toward the discharge port 47.

In addition, when the wall 130B includes the recess 134 open toward the ceiling 44*a* also, the ink with the characteristics changed owing to residing between the wall 130 and the ceiling 44*a* remains inside the recess 134, and therefore the ink of different characteristics can be prevented from being introduced into the pressure generating chamber 12.

Figure 10:
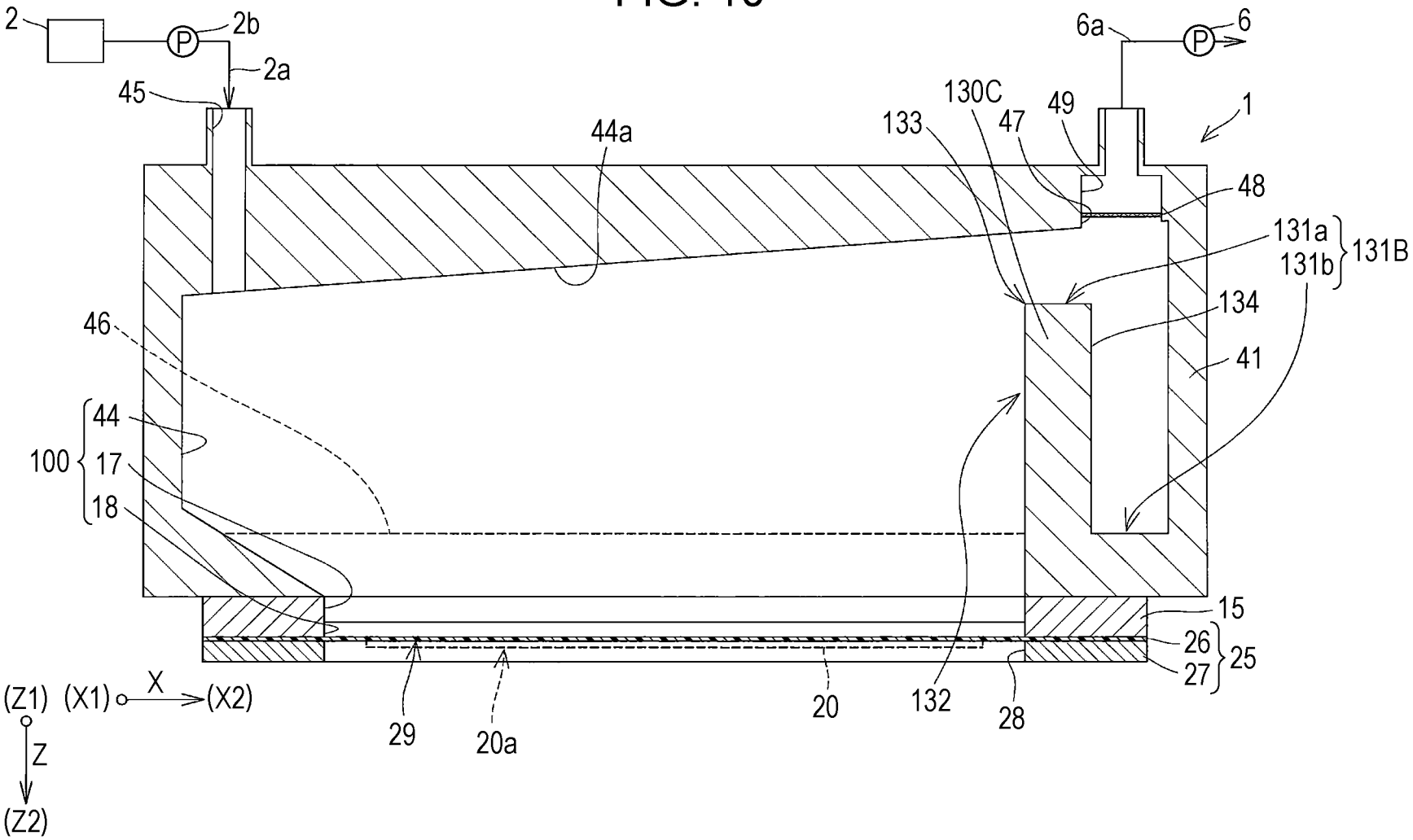
FIG. 10 is a cross-sectional view of a wall according to another variation of the third embodiment of the invention.

In the example shown in FIG. 9, the surface 132 of the wall 130 oriented to the X1-side is formed as a sloped surface, as in the first embodiment, however different configurations may be adopted. For example, as shown in FIG. 10, the surface 132 of a wall 130C oriented to the X1-side may be formed so as to extend along the third direction Z. In such a case also, forming the recess 134 allows the ink of different characteristics to remain inside the recess 134, thus to prevent the ink of different characteristics from being introduced to the pressure generating chamber 12. Naturally, the wall 130C shown in FIG. 10 may also include the floor surface 131A, which is the sloped surface shown in FIG. 8.

Other Embodiments

Although some embodiments of the invention have been described above, the basic configuration of the invention is not limited to the foregoing embodiments.

For example, although the wall 130 is formed in the third manifold section 44, constituting the manifold 100 in the space provided in the casing 40 of the recording head 1, different configurations may be adopted. For example, the manifold 100, and a sub tank located upstream of the manifold 100 and communicating therewith may be provided in the recording head 1, and the wall 130 may be formed in a common liquid chamber in the sub tank.

Figure 11:
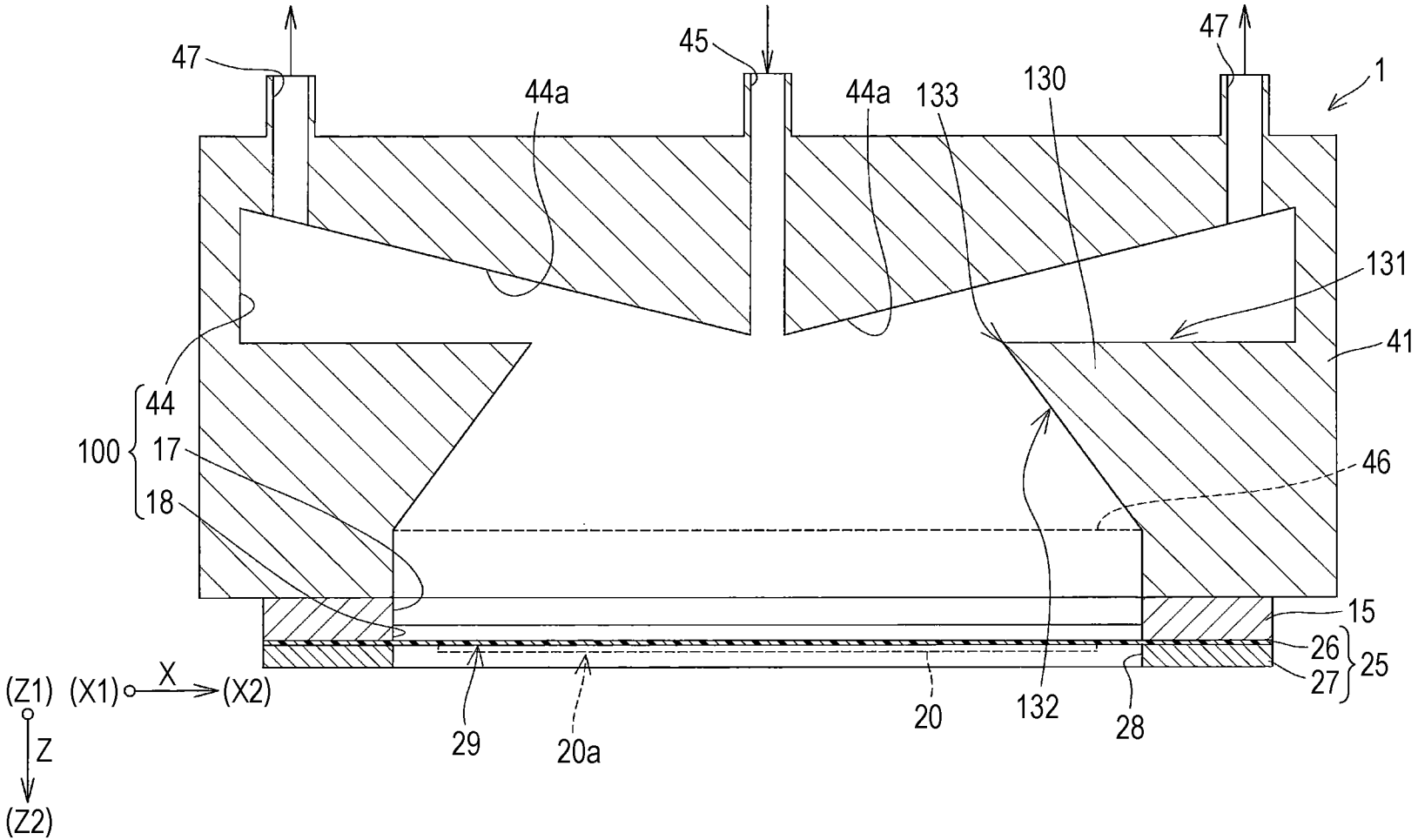
FIG. 11 is a cross-sectional view of the recording head according to another embodiment of the invention.

Although the supply port 45 is located on the X1-side of the manifold 100 in the foregoing embodiments, different configurations may be adopted. FIG. 11 illustrates a variation of the supply port 45. As shown in FIG. 11, the supply port 45 may be located so as to have the opening at a central position of the ceiling 44*a* of the manifold 100, in the first direction X. In the case where the supply port 45 is formed at the central position of the ceiling 44*a* of the manifold 100 as shown in FIG. 11, the discharge port 47 may be provided, for example, at each of the end portions of the manifold 100 on the X1-side and the X2-side, and the wall 130 may be provided on each of the X1-side and the X2-side, so as to correspond to the discharge port 47 on the X1-side and the X2-side. In addition, the ceiling 44*a* may be formed so as to be farther from the nozzle surface 20*a* toward the X1-side and the X2-side, from the opening of the supply port 45.

Although the supply port 45 and the discharge port 47 in the manifold 100 communicate with each other without intermediation of the pressure generating chamber 12, in the foregoing embodiments, the supply port 45 and the discharge port 47 may communicate with each other exclusively through the pressure generating chamber 12. In this case, the manifold 100 only communicates with the pressure generating chamber 12.

Figure 12:
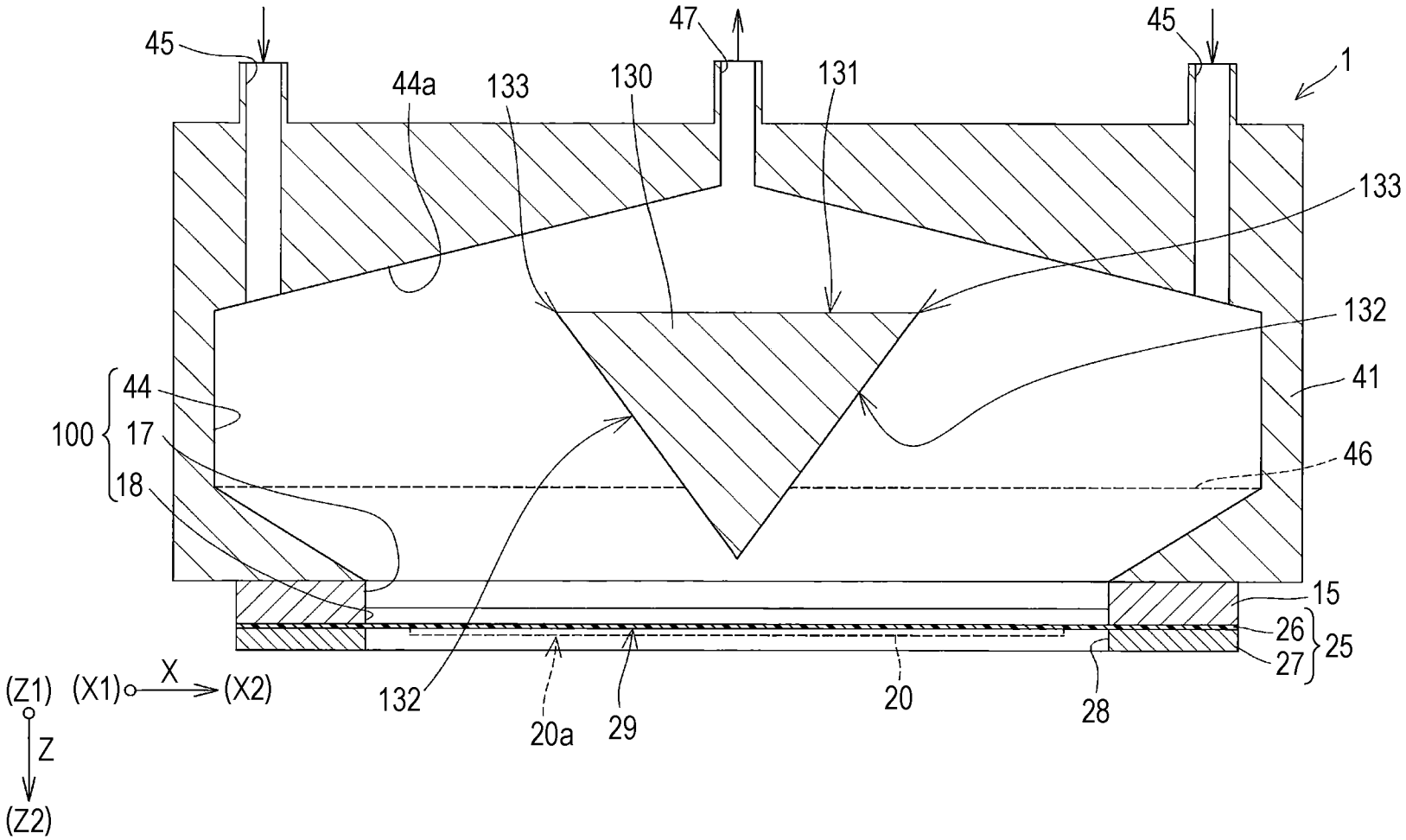
FIG. 12 is a cross-sectional view of the recording head according to still another embodiment of the invention.

Likewise, the discharge port 47 may be located so as to have the opening at a central position of the manifold 100 in the first direction X, and the supply port 45 may be provided on each of the X1-side and the X2-side, as shown in FIG. 12. In such a case also, providing the wall 130 prevents the ink flow from stagnating, and also prevents the ink of different characteristics located right under the discharge port 47 from being introduced into the pressure generating chamber 12.

Although the thin-film piezoelectric actuator 300 is employed as the pressure generating device for causing pressure fluctuation in the pressure generating chamber 12, in the foregoing embodiments, different devices may be adopted. For example, a thick-film piezoelectric actuator formed by laminating green sheets, or a vertical vibration type piezoelectric actuator formed of a piezoelectric material and an electrode material alternately stacked, and configured to stretch in the axial direction, may be employed. Alternative examples of the pressure generating device include a device including a heating element in the pressure generating chamber and configured to eject liquid droplets from nozzle openings with bubbles generated by the heat of the heating element, and what is known as an electrostatic actuator, configured to generate static electricity between a vibration plate and an electrode and deform the vibration plate with the electrostatic force, to thereby eject liquid droplets from nozzle openings.

In the foregoing ink jet recording apparatus I, the recording head 1 is mounted on the carriage 3 to move in the main scanning direction. However, the invention is also applicable, for example, to a line recording apparatus in which the recording head 1 is fixed, configured to perform printing by moving the recording sheet S such as a paper sheet in the sub scanning direction.

Further, although the storage device 2 such as an ink tank is fixed in the main body 4, in the foregoing ink jet recording apparatus I, for example a storage device such as an ink cartridge may be mounted on the carriage 3, together with the recording head 1.

Although the liquid ejecting head is exemplified by the ink jet recording head, and the liquid ejecting apparatus is exemplified by the ink jet recording apparatus in the foregoing embodiments, the invention broadly encompasses the liquid ejecting heads and liquid ejecting apparatuses, and is naturally applicable to liquid ejecting heads and liquid ejecting apparatuses that eject a liquid other than the ink. Examples of other types of liquid ejecting heads include various recording heads employed in image recording apparatuses such as a printer, a color material ejecting head used for manufacturing color filters of liquid crystal displays, an electrode material ejecting head used for manufacturing electrodes for organic EL displays and field emission displays (FED), and a bioorganic substance ejecting head used for manufacturing biochips, and the invention is also applicable to liquid ejecting apparatuses that include the cited liquid ejecting heads.

What is claimed is:

1. A liquid ejecting apparatus comprising:

a flow path member including a common liquid chamber communicating with each of a plurality of nozzles formed in a nozzle surface, via a corresponding pressure generating chamber;

a supply port provided in an inner wall of the common liquid chamber to supply a liquid to the common liquid chamber;

a discharge port provided in a ceiling of the common liquid chamber to discharge an air bubble from the common liquid chamber; and a wall continuously extending from the inner wall, including a surface opposing the discharge port, wherein the discharge port is located on an outer side of the pressure generating chamber, in a direction in which the pressure generating chambers are aligned.

2. The liquid ejecting apparatus according to claim 1, wherein the ceiling includes a sloped surface formed so as to be farther from the nozzle surface, toward the discharge port.

3. The liquid ejecting apparatus according to claim 1, wherein the wall includes a floor surface opposing the ceiling, and formed so as to be closer to the nozzle surface, toward the discharge port.

4. The liquid ejecting apparatus according to claim 1, wherein the supply port is provided in the ceiling, the wall is configured so as to generate, in the common liquid chamber, a first flow from the supply port to a plurality of the pressure generating chambers, and a second flow from the supply port to the discharge port, and a portion of the wall that generates the first flow includes a sloped surface formed so as to be closer to the nozzle surface, in a direction away from the supply port.

5. The liquid ejecting apparatus according to claim 1, wherein the wall is configured so as to generate, in the common liquid chamber, a first flow from the supply port to a plurality of the pressure generating chambers, and a second flow from the supply port to the discharge port, and the first flow and the second flow are branched at a position upper than a center of the common liquid chamber, in a direction in which the ceiling and a portion of the common liquid chamber communicating with the pressure generating chamber oppose each other.

6. The liquid ejecting apparatus according to claim 1, wherein the discharge port communicates with a degassing chamber including a gas-liquid separation wall.

7. The liquid ejecting apparatus according to claim 1, wherein the discharge port is configured to discharge the air bubble inside the common liquid chamber.

8. The liquid ejecting apparatus according to claim 1, wherein the discharge port is configured to return the liquid, supplied through the supply port from a tank for storing the liquid, to the tank.

9. A liquid ejecting apparatus comprising:

a flow path member including a common liquid chamber communicating with each of a plurality of nozzles formed in a nozzle surface, via a corresponding pressure generating chamber;

a supply port provided in an inner wall of the common liquid chamber to supply a liquid to the common liquid chamber;

a discharge port provided in a ceiling of the common liquid chamber to discharge an air bubble from the common liquid chamber; and a wall continuously extending from the inner wall, including a first surface opposing the discharge port, and including a second surface that opposes the discharge port and does not oppose the supply port.

10. The liquid ejecting apparatus according to claim 9, wherein the first surface and the second surface are connected to each other.

11. The liquid ejecting apparatus according to claim 9, wherein the plurality of nozzles are arranged in an arranging direction, and wherein an angle between a lengthen direction of the first surface and the arranging direction is larger than an angle between a lengthen direction of the second surface and the arranging direction.

* * * * *